United States Patent [19]

Altherr

[11] Patent Number: 4,976,363

[45] Date of Patent: Dec. 11, 1990

[54] KNUCKLE PIN RETAINER FOR RAILWAY VEHICLE COUPLER

[75] Inventor: Russell G. Altherr, Munster, Ind.

[73] Assignee: AMSTED Industries Incorporated, Chicago, Ill.

[21] Appl. No.: 443,497

[22] Filed: Nov. 30, 1989

[51] Int. Cl.[5] ..... B61G 3/00

[52] U.S. Cl. ..... 213/155; 213/156

[58] Field of Search ..... 213/156, 155, 100 R, 213/100 W, 104, 105, 108, 109, 110, 152, 153

[56] References Cited

U.S. PATENT DOCUMENTS

| | | | |
|---|---|---|---|
| 447,969 | 3/1891 | McConway | 213/155 |
| 549,363 | 11/1895 | Ide | 213/156 |
| 702,186 | 6/1902 | Chubb | 213/156 |
| 763,883 | 6/1904 | Harlow | 213/156 |
| 820,644 | 5/1906 | Hinson | 213/111 |
| 974,509 | 11/1910 | Murray | 213/156 |
| 1,010,055 | 11/1911 | Janney | 213/109 |
| 1,066,845 | 7/1913 | Richards | 213/109 |
| 1,093,858 | 4/1914 | Janney | 213/155 |
| 2,456,355 | 12/1948 | Aber | 411/360 |
| 3,627,145 | 12/1971 | Altherr | 213/153 |
| 3,854,599 | 12/1974 | Day et al. | 213/100 R |
| 3,998,337 | 12/1976 | Altherr | 213/153 |
| 4,129,219 | 12/1978 | Polanin | 213/100 R |
| 4,438,855 | 3/1984 | Altherr | 213/153 |

*Primary Examiner*—Robert P. Olszewski
*Assistant Examiner*—Mark T. Le
*Attorney, Agent, or Firm*—Edward J. Brosius; Charles E. Bouton

[57] ABSTRACT

Am improved railway vehicle coupler head is provided having knuckle pin retaining element which is free to fully rotate with the knuckle pin to enable continuous rotation of the knuckle pin during use. An elastic ring located within a circumferential groove on a bottom portion of the knuckle pin precludes the knuckle pin from unintentional upward removal during use while allowing for continuous rotation therewithin. The continuous rotation of the knuckle pin allows for the distribution of stress about the circumference of a knuckle pin resulting in a longer fatigue life for the knuckle pin.

2 Claims, 3 Drawing Sheets

KNUCKLE PIN RETAINER FOR RAILWAY VEHICLE COUPLER

BACKGROUND OF THE INVENTION

The present invention relates to railway vehicle couplers and more particularly to an improved railway coupler head having knuckle pin retaining means that are free to fully rotate with the knuckle pin.

Both AAR Type E and Type F railway coupler heads are known to have knuckles which interface with and receive the transferred draft load from opposing knuckles of mating coupler heads. Further, both type coupler heads are known with a knuckle pin which passes through an aperture having a circular cross-section in the knuckle as well as through aligned apertures having elongated non-circular cross-sections in the upper and lower pivot lugs on either side of the knuckle. The knuckle pin serves to secure the knuckle to the coupler head while allowing for the knuckle to pivot between an open and closed position.

The knuckle pins are currently retained within the aligned apertures by a cotter pin which passes through a transverse hole in the bottom portion of the knuckle pin that extends downwardly from the bottom surface of the lower pivot lug. Such a retention device is shown in Altherr, U S. Pat. No. 3,627,145. When the knuckle pin moves upwardly during use, the cotter pin comes into contact with the bottom surface of the lower pivot lug precluding against any further upward movement which would result in the unintentional removal of the knuckle pin.

A problem that has occurred with the current arrangement for retaining the knuckle pin is that, as the knuckle pin turns initially within the aligned apertures of the pivot lugs, the cotter pin contacts and becomes caught upon a flange section of the coupler head which protrudes downwardly from the bottom surface of the lower pivot lug in close proximity to the bottom portion of the knuckle pin in which the cotter pin is received. The cotter pin, while caught upon the downwardly protruding flange section, restricts any further rotation of the knuckle pin within the pivot lugs. Thus, the cotter pin actually prevents rotation of the knuckle pin.

Excessive knuckle pin failures have been experienced on a plane perpendicular to the knuckle pin axis at the longitudinal position along the knuckle pin between the knuckle and the upper pivot lug. This position is the most vulnerable due to the fact that there is a small slack gap between the knuckle and the upper pivot lug during use as the knuckle rests on the lower pivot lug. This slack gap, combined with the absence of knuckle pin rotation caused by the cotter pin, creates an area of point stress on the knuckle pin which results in a reduced fatigue life for the knuckle pin.

SUMMARY OF THE INVENTION

Accordingly, it is an object of the present invention to provide an improved coupler head with means for retaining a knuckle pin which will increase the fatigue life of the knuckle pin.

It is another object of the present invention to provide means for retaining a knuckle pin in which the knuckle pin is free to rotate during use.

By the present invention, it is proposed to overcome the difficulties encountered heretofore. To this end, it has been discovered that providing the coupler head with knuckle pin retaining means that are free to fully rotate with the knuckle pin, thus allowing the knuckle pin to rotate during use, will enable the slack point stress to be distributed along the circumference of the knuckle pin resulting in a longer fatigue life for the knuckle pin and, in turn, the coupler. The retaining means conform closely to the surface of the cylindrical knuckle pin and will accordingly not become caught on the downwardly protruding flange section. At the same time, the retaining means project from the surface of the knuckle pin at least enough so as not to pass upwardly through the aligned apertures thus precluding unintentional removal of the knuckle pin during use. In order to improve the resistance of the retaining means against failure upon contact with the bottom surface of the lower pivot lug, the bottom surface of the lower pivot lug is chamfered about the elongated non-circular aperture to create a circular seat for the retaining means promoting uniform contact and wear at all points on the retaining means.

DESCRIPTION OF THE PREFERRED EMBODIMENT

Figure 1:
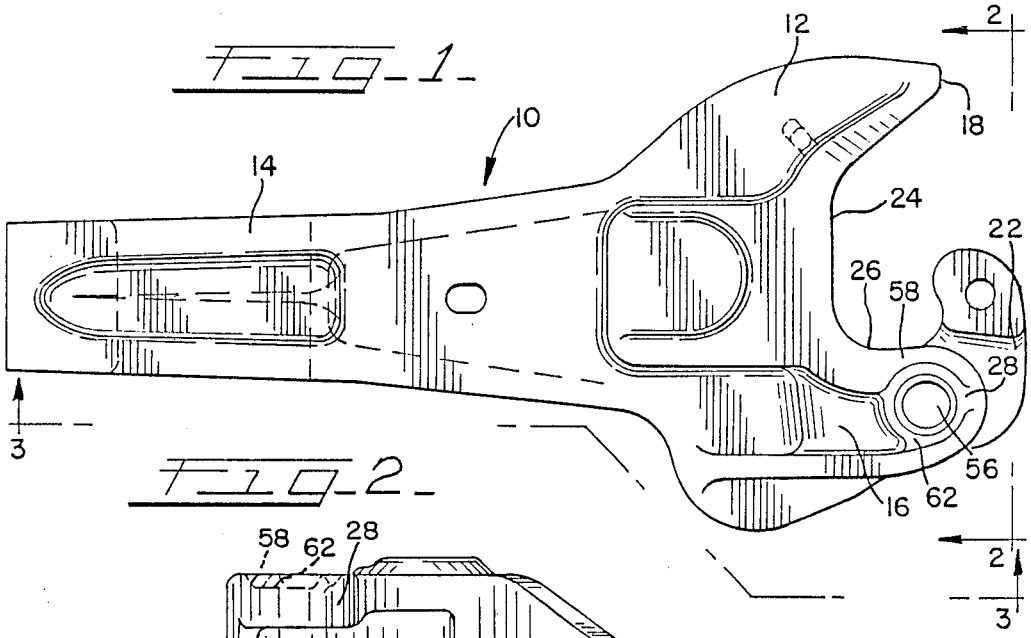
FIG. 1 is a top plan view of an E-type coupler head embodying the present invention.
Figure 2:
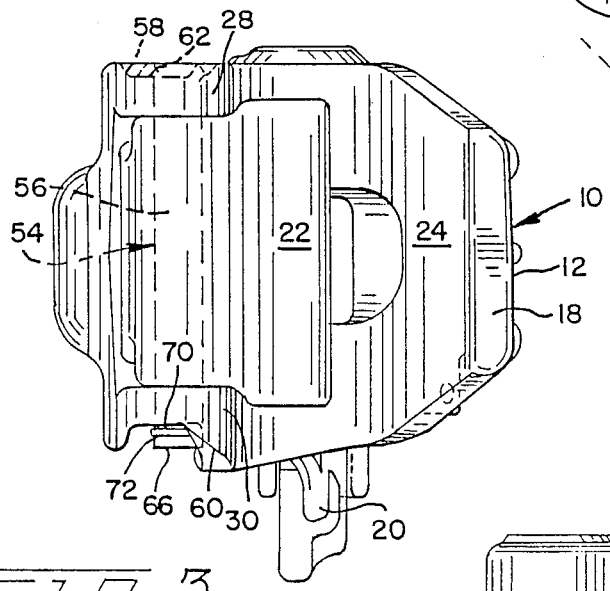
FIG. 2 is an end elevation view of the coupler head taken along lines 2—2 of FIG. 1.
Figure 3:
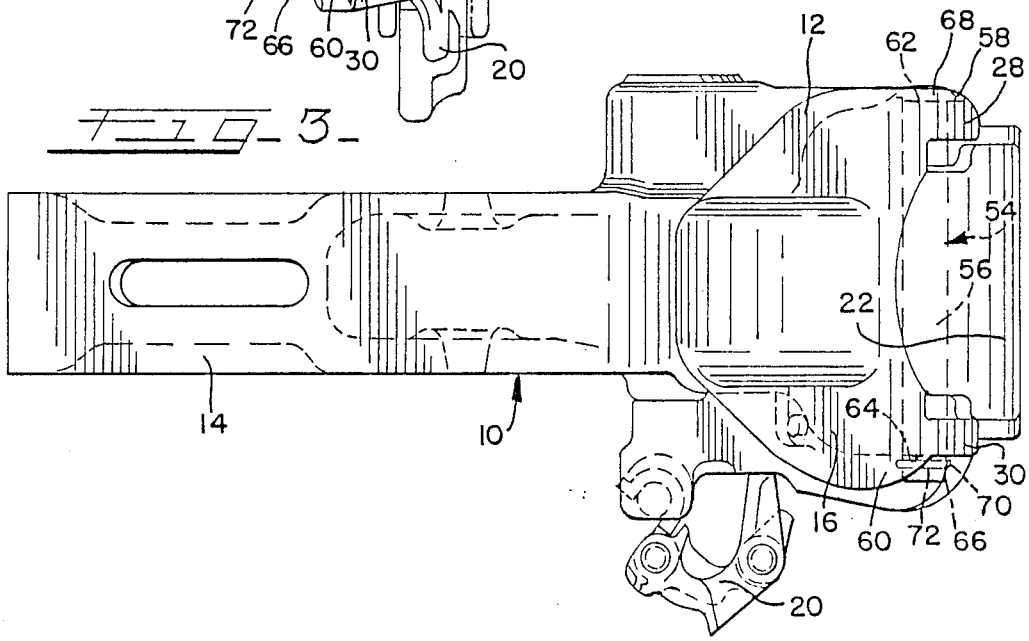
FIG. 3 is a side elevation view of the coupler head taken along lines 3—3 of FIG. 1.
Figure 4:
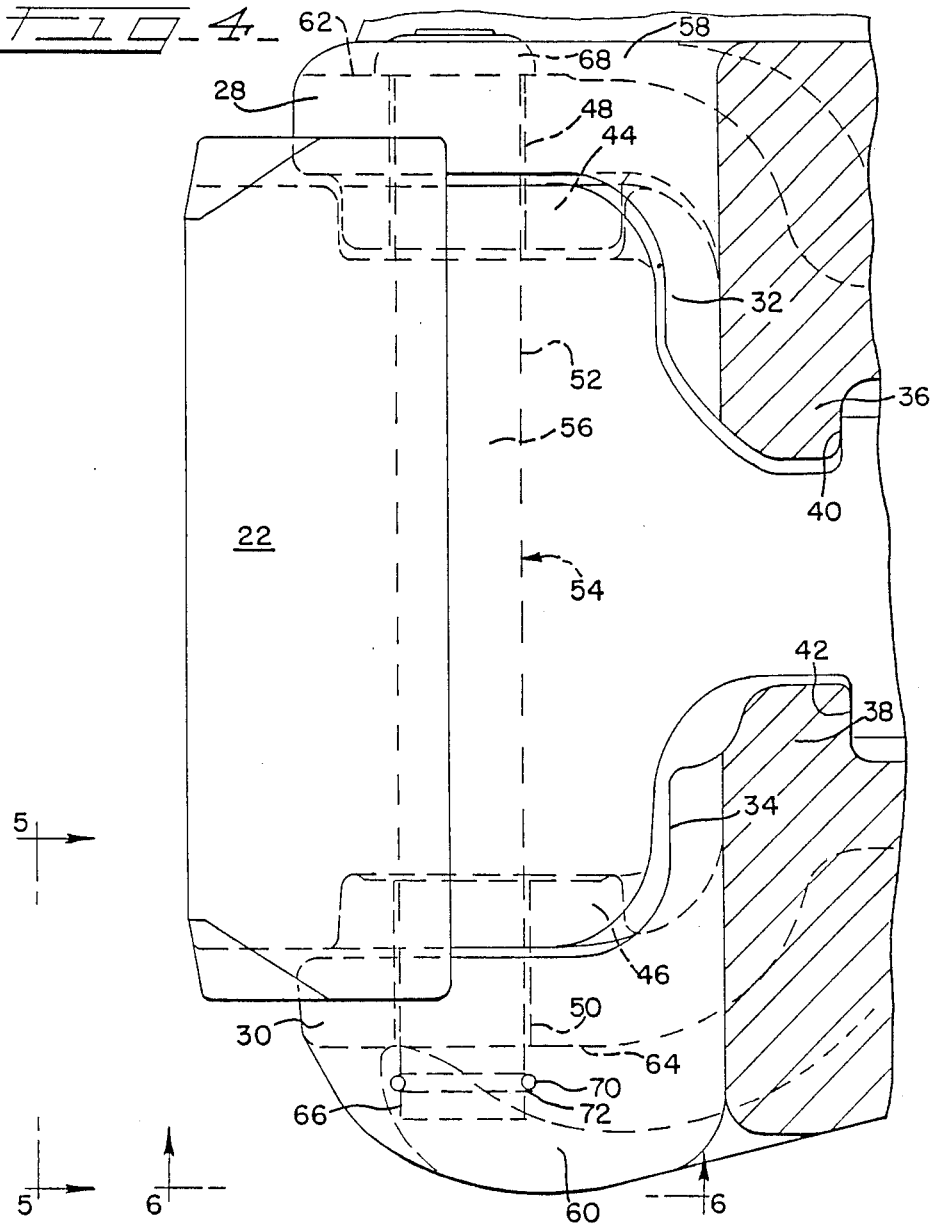
FIG. 4 is an enlarged partial side elevation view of the opposite side of the coupler head shown in FIG. 3.

In FIGS. 1–4, an E-type coupler embodying the improved design of the present invention is shown generally at 10. The coupler 10 comprises generally a coupler head 12 and a shank 14 which is adapted to be mounted in a draft gear (not shown) on the end of a car sill (not shown) of a railway vehicle (not shown). The knuckle side of coupler head 12 is shown at 16 and the guard arm side at 18. A rotary lock-lift assembly 20 is mounted on coupler head 12 to release a knuckle 22 from its closed position. Coupler head 12 has a front face 24 including a throat portion 26 extending toward knuckle side 16 in a curved manner toward upper pivot lug 28 and lower pivot lug 30. Located behind pivot lugs 28 and 30 are buffing shoulders 32 and 34 which form a pocket for receiving knuckle 22. Projecting from buffing shoulders 32 and 34 are upper pulling lug 36 and lower pulling lug 38 which are engaged by corresponding pulling surfaces 40 and 42 respectively of knuckle 22. Upper pivot lug 28 narrows toward knuckle 22 into pin protector 44.

Likewise, lower pivot lug 30 narrows toward knuckle 22 into pin protector 46.

Figure 6:
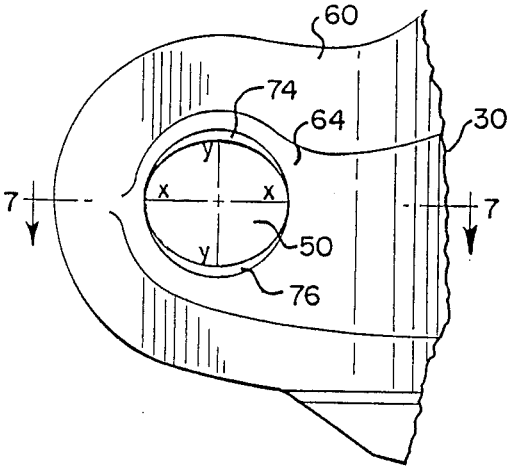
FIG. 6 is a partial bottom plan view of the coupler head taken along lines 6—6 of FIG. 4 with the knuckle and knuckle pin removed.

Upper pivot lug 28 and lower pivot lug 30 include pin apertures 48 and 50 respectively having elongated non-circular cross-sections. It is these apertures 48 and 50 combined with a third aligned aperture 52 in knuckle 22 having a circular cross-section that form a single passageway 54 through which knuckle pin 56 is received. Pin apertures 48 and 50 may have a major axis X—X being in the same direction as the longitudinal axis of coupler 10 and the minor axis Y—Y being in a direction transverse to the longitudinal axis of coupler 10 as shown in FIG. 6. The elongated pin apertures 48 and 50 provide the slack necessary for the primary pulling load to be transmitted from knuckle 22 to pulling lugs 36 and 38 as well as pin protectors 44 and 46 without exerting excessive loads on knuckle pin 56. They also provide the slack necessary for the primary buff load to be transmitted from knuckle 22 to buffing shoulders 32 and 34 and pin protectors 44 and 46 again without exerting excessive loads on knuckle pin 56.

Coupler head 12 includes outwardly protruding flange sections 58 and 60 from the top surface 62 of upper pivot lug 28 and the bottom surface 64 of lower pivot lug 30 respectively. In addition to pulling and buffing loads on coupler head 12 during use, a bending load is present which acts to pull upper pivot lug 28 away from lower pivot lug 30. These flange sections 58 and 60 provide the necessary strength to preclude pivot lugs 28 and 30 from bending away from each other. It is downwardly protruding flange section 60 upon which the cotter pin of the prior art has become caught thus restricting knuckle pin 56 from further rotation and reducing the fatigue life of knuckle pin 56.

Knuckle pin 56 comprises a longitudinal cylindrical member having a circular cross-section and a length greater than that of passageway 54 such that a bottom portion 66 of knuckle pin 56 extends downwardly from bottom surface 64 of lower pivot lug 30 when knuckle pin 56 is placed within passageway 54. Knuckle pin 56 has an enlarged cap 68 having a diameter greater than that of passageway 54 so as to abut the top surface 62 of upper pivot lug 28 and preclude knuckle pin 56 from moving downwardly during use.

According to the present invention, knuckle pin 56 is locked within passageway 54 and restricted from unintentional upward removal during use by retaining means that are free to fully rotate with knuckle pin 56. For the sake of convenience, it is preferred that the retaining means be located on or near the bottom portion 66 of knuckle pin 56 that extends downwardly from the bottom surface 64 of lower pivot lug 30. It is important that the retaining means conform closely to the surface of cylindrical knuckle pin 56 so as not to become caught upon downwardly protruding flange section 60. At the same time, it is also important that retaining means project from the surface of knuckle pin 56 at least enough so as not to pass upwardly through passageway 54. The retaining means may take the form of one or more surface indentations on knuckle pin 56 combined with an arcuate gripping member which at least partially encircles knuckle pin 56 and which is seated in the surface indentations.

The preferred form of the retaining means include an elastic ring 70 located within a circumferential groove 72 on the bottom portion 66 of knuckle pin 56 that extends downwardly from the bottom surface 64 of lower pivot lug 30. Elastic ring 70 projects from circumferential groove 72 a distance which makes the total diameter of the cross-section of knuckle pin 56 combined with elastic ring 70 greater than that of lower pivot pin aperture 50 of passageway 54. Thus, when knuckle pin 56 moves upwardly during use, elastic ring 70 comes into abutting contact with bottom surface 64 of lower pivot lug 30 restricting knuckle pin 56 from any further upward movement which would result in unintentional removal.

Unlike the cotter pin retaining device of the prior art, elastic ring 70 fits closely about knuckle pin 56, and there is no contact between elastic ring 70 and downwardly protruding flange section 60. Accordingly, knuckle pin 56 and elastic ring 70 are free to rotate continuously during use of coupler 10. Consequently, the slack point stress on knuckle pin 56 at the longitudinal point along knuckle pin 56 between knuckle 22 and upper pin protector 44 is distributed along the circumference of knuckle pin 56 resulting in a longer fatigue life for knuckle pin 56.

Figure 5:
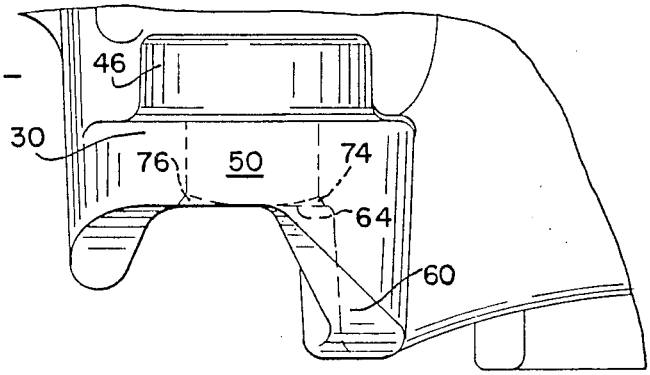
FIG. 5 is a partial end elevation view of the coupler head taken along lines 5—5 of FIG. 4 with the knuckle and knuckle pin removed.
Figure 7:
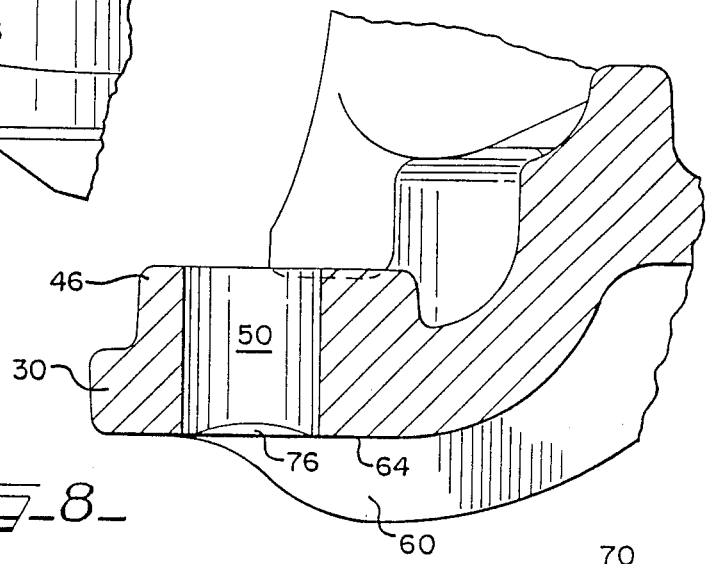
FIG. 7 is a partial elevation view shown in cross-section of the coupler head taken along lines 7—7 of FIG. 6.

Due to the fact that lower pivot pin aperture 50 of lower pivot lug 30 has an elongated non-circular cross-section, it is preferred that the bottom surface 64 of lower pivot lug 30 include chamfers 74 and 76 about aperture 50 as shown in FIGS. 5–7. Chamfers 74 and 76 are located on the sides of aperture 50 at either end of minor axis Y—Y and create a circular area of contact for elastic ring 70 when knuckle pin 56 moves upwardly during use. This is important because if elastic ring 70 were to contact the rim of the non-circular aperture 50 without chamfers 74 and 76, the area of contact would be at the two points at either end of minor axis Y—Y and elastic ring 70 would be much more easily overcome by the upward movement of knuckle pin 56. The uniform circumferential area of contact created by chamfer 74 and 76 makes for a much greater resistance against undesired removal as well as wear of elastic ring 70.

It is preferred that elastic ring 70 be of a resilient material such as rubber so that it may be expanded around the bottom portion 66 of knuckle pin 56 and will automatically contract around circumferential groove 72 without the use of a tool to remove or apply elastic ring 70. In the alternative, elastic ring 70 may comprise a split metallic ring (not shown) which is either spring biased or tightened down with a tool after it has been placed in circumferential groove 72.

Figure 8:
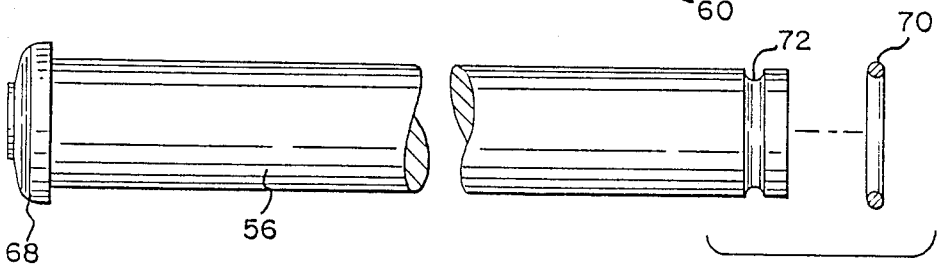
FIG. 8 is an exploded view of the knuckle pin and retainer ring of the present invention.
Figure 9:
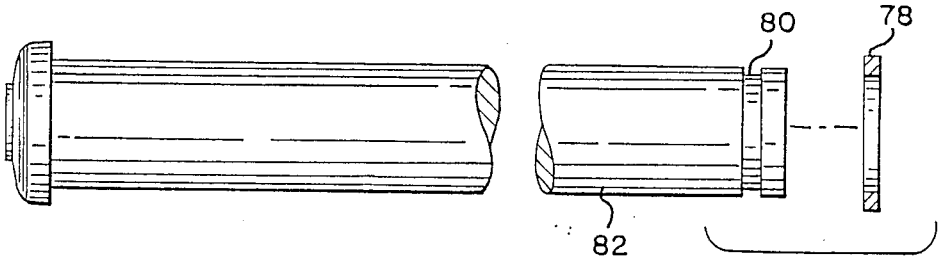
FIG. 9 is an exploded view of an alternative knuckle pin and retainer ring of the present invention.

While, it is also preferred that elastic ring 70 have a circular cross-section and circumferential groove 72 have a corresponding arcuate cross-section as shown in FIG. 8, other alternatives are possible such as the rectangular shaped cross-section of elastic ring 78 and corresponding rectangular shaped circumferential groove 80 in alternative knuckle pin 82 of FIG. 9.

The foregoing description and drawings explain and illustrate the best known mode of the invention and those skilled in the art who have the disclosure before them will be able to make modifications and variations therein without departing from the scope of the invention which is defined in the following claims.

What is claimed is:

1. An improved coupler head for use in joining adjacent railway vehicles wherein said coupler head includes a knuckle, said knuckle being secured within an opening located between an upper pivot lug and a lower pivot lug of said coupler head by a knuckle pin, said knuckle pin being received within a passageway formed by aligned apertures in said upper pivot lug, knuckle and lower pivot lug allowing for pivotal movement between said coupler head and said knuckle, said passageway having an elongated non-circular cross-section in said upper and lower pivot lugs and a circular cross-section in said knuckle, the improvement comprising:

an elastic retaining ring located within a circumferential groove on a portion of said knuckle pin which extends downwardly from said lower pivot lug end of said passageway, said elastic retaining ring which is free to rotate fully with said knuckle pin thereby allowing for continuous rotation of said knuckle pin within said passageway, said retaining ring projecting from said circumferential groove a distance to create a combined diameter greater than the diameter of said elongated non-circular passageway in said lower pivot lug, said lower pivot lug having a bottom surface which is chamfered about said elongated non-circular passageway to create a uniform circular area of contact for said retaining ring.

2. An improved railway coupler of the type including a coupler head and a knuckle, said knuckle being pivotally secured by a knuckle pin between an upper and lower pivot lug on said coupler head, said knuckle pin which passes through an aperture in said upper pivot lug, an aligned aperture in said knuckle, and an aligned aperture in said lower pivot lug, said passageway having an elongated non-circular cross-section in said upper and lower pivot lugs and a circular cross-section in said knuckle, the improvement comprising:

an elastic retaining ring located within a circumferential groove on a portion of said knuckle pin which extends downwardly from said lower pivot lug end of said passageway, said elastic retaining ring which is free to rotate with said knuckle pin while allowing for continuous rotation of said knuckle pin within said aligned apertures, said retaining ring projecting from said circumferential groove a distance to create a combined diameter greater than the diameter of said elongated non-circular passageway in said lower pivot lug, said lower pivot lug having a bottom surface which is chamfered about said elongated non circular passageway to create a uniform circular area of contact for said retaining ring.

* * * * *